US011264690B2

(12) United States Patent
Deleniv et al.

(10) Patent No.: US 11,264,690 B2
(45) Date of Patent: Mar. 1, 2022

(54) TUNABLE WAVEGUIDE RESONATOR

(71) Applicant: Telefonaktiebolaget LM Ericsson (publ), Stockholm (SE)

(72) Inventors: Anatoli Deleniv, Mölndal (SE); Ove Persson, Hunnebostrand (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 17/051,404

(22) PCT Filed: May 4, 2018

(86) PCT No.: PCT/EP2018/061631
§ 371 (c)(1),
(2) Date: Oct. 28, 2020

(87) PCT Pub. No.: WO2019/210980
PCT Pub. Date: Nov. 7, 2019

(65) Prior Publication Data
US 2021/0242562 A1 Aug. 5, 2021

(51) Int. Cl.
*H01P 7/00* (2006.01)
*H01P 7/06* (2006.01)
*H01P 1/207* (2006.01)

(52) U.S. Cl.
CPC ..... *H01P 7/06* (2013.01); *H01P 1/207* (2013.01)

(58) Field of Classification Search
CPC .. H01P 1/207; H01P 1/208; H01P 3/12; H01P 7/06; H01P 7/00
USPC ..... 333/227, 209, 202, 208, 231, 232
See application file for complete search history.

(56) References Cited

U.S. PATENT DOCUMENTS 7,012,488 B2 3/2006 Beis et al.
2014/0028415 A1* 1/2014 Perigaud ..... H01P 1/2086 333/202
2015/0180105 A1* 6/2015 Jolly ..... H01P 1/2086 333/209

FOREIGN PATENT DOCUMENTS

EP 0580193 A2 1/1994
WO 2018069864 A1 4/2018

OTHER PUBLICATIONS

International Search Report and Written Opinion of the International Searching Authority for PCT International Application No. PCT/EP2018/061631 dated Jan. 16, 2019.
Matthaei et al., "Microwave Filters, Impedance-Matching Networks, and Coupling Structures," Sec. 15.04, McGraw-Hill Publishers, 1964, pp. 921-923.
(Continued)

*Primary Examiner* — Stephen E. Jones
(74) *Attorney, Agent, or Firm* — Sage Patent Group

(57) ABSTRACT

The present disclosure relates to a tunable waveguide resonator comprising a rectangular waveguide part having electrically conducting inner walls, a first waveguide port and a second waveguide port. The resonator comprises at least one tuning element positioned between the waveguide ports, where each tuning element comprises an electrically conducting body and a holding rod. The holding rod is attached to the electrically conducting body and is movable from the outside of the resonator such that the electrically conducting body can be moved between a plurality of positions within the waveguide part by means of the holding rod.

10 Claims, 3 Drawing Sheets

(56) References Cited

OTHER PUBLICATIONS

Kunes et al., "A Digitally Controlled Tunable High Power Output Filter for Space Applications," in Proc.EuMC, British Aerospace (Space Systems) Ltd., Argyle Way, Stevenage, Hertfordshire, UK, Sep. 1989, pp. 681-686.
Yassini et al., "A Ka-Band Fully Tunable Cavity Filter," IEEE Transactions on Microwave Theory and Techniques, vol. 60, No. 12, Dec. 2012, pp. 4002-4012.
Wang et al., "Dual-Mode Conductor-Loaded Cavity Filters," 26th European Microwave Conference (IEEE Transactions on Microwave Theory and Techniques, vol. 45, No. 8, Aug. 1997) pp. 1240-1246.

* cited by examiner

TUNABLE WAVEGUIDE RESONATOR

CROSS REFERENCE TO RELATED APPLICATION

This application is a 35 U.S.C. § 371 national stage application of PCT International Application No. PCT/EP2018/061631 filed on May 4, 2018, the disclosure and content of which is incorporated by reference herein in its entirety.

TECHNICAL FIELD

The present disclosure relates to a tunable waveguide resonator comprising a rectangular waveguide part having electrically conducting inner walls, a first waveguide port and a second waveguide port. The resonator comprises at least one tuning element positioned between the waveguide ports.

BACKGROUND

In wireless communication networks there is radio equipment that in many cases comprises waveguide resonators that for example are used for filters, and for some applications it is desirable to have one or more tunable waveguide resonators such as for example short haul diplexers and similar.

Practical implementation of tunable resonators with low insertion loss depends on availability of the tunable resonators with a high Q-factor and a large spurious-free band. It is also important that a tunable resonator is reliable and inexpensive to produce.

A number of solutions use cavities where one complete side is moved and typically is connected to the cavity wall by sliding contacts; such a design results in relatively high insertion loss, meaning that a high Q-factor cannot be achieved.

A mechanically tuned cavity is disclosed in U.S. Pat. No. 7,012,488 where two part forming a cavity can be displaced with respect to each other allowing adjustment of the cavity length. The cross-sectional plane is chosen at the electric field's maximum such that zero current is flowing through the contact between two parts. However, when moving away from a center frequency, the current crossing contact area increases which leads to increased loss and reduces useful tuning range.

There is thus a need for a tunable waveguide resonator that combines high Q-factor, wide spurious free band and is compact.

SUMMARY

It is an object of the present disclosure to provide a tunable waveguide resonator that combines high Q-factor, wide spurious free band and is compact.

Said object is obtained by means of a tunable waveguide resonator comprising a rectangular waveguide part having electrically conducting inner walls, a first waveguide port and a second waveguide port. The resonator comprises at least one tuning element positioned between the waveguide ports. Each tuning element comprises an electrically conducting body and a holding rod, where the holding rod is attached to the electrically conducting body and is movable from the outside of the resonator such that the electrically conducting body can be moved between a plurality of positions within the waveguide part by means of the holding rod.

This provides a compact tunable waveguide resonator with high Q-factor and a wide spurious free band.

According to some aspects, the waveguide ports are constituted by iris openings.

This enables connecting several tunable waveguide resonators in series.

According to some aspects, the holding rod is electrically conducting.

This enables manufacture of the holding rod and the electrically conducting body as a single part.

According to some aspects, the holding rod is extending through the waveguide part via corresponding apertures, where these apertures cross a plane running through the waveguide part parallel to an extension axis of the holding rod when mounted. Only a mode with an electrical wall in the plane is excited within the apertures such that power leakage via the apertures is avoided.

According to some aspects, the holding rod is connected to an electrically controllable motor.

In this way, an electrically controlled tuning, that can be adaptable, is enabled.

According to some aspects, the electrically conducting body is a cylindrical part.

In this way, the electrically conducting body can be rotated without changing its shape in the waveguide part, for example if the moving of the electrically conducting body is performed by rotating the holding rod.

According to some aspects, the tuning element is integrally formed as one part.

Alternatively, the holding rod comprises two separate rod parts that are attached to opposite sides of the electrically conducting body.

Alternatively, the holding rod comprises one integral part that is running through the electrically conducting body.

In this way, the tuning element can be manufactured in many suitable manners.

BRIEF DESCRIPTION OF THE DRAWINGS

The present disclosure will now be described more in detail with reference to the appended drawings, where.

DETAILED DESCRIPTION

Figure 1:
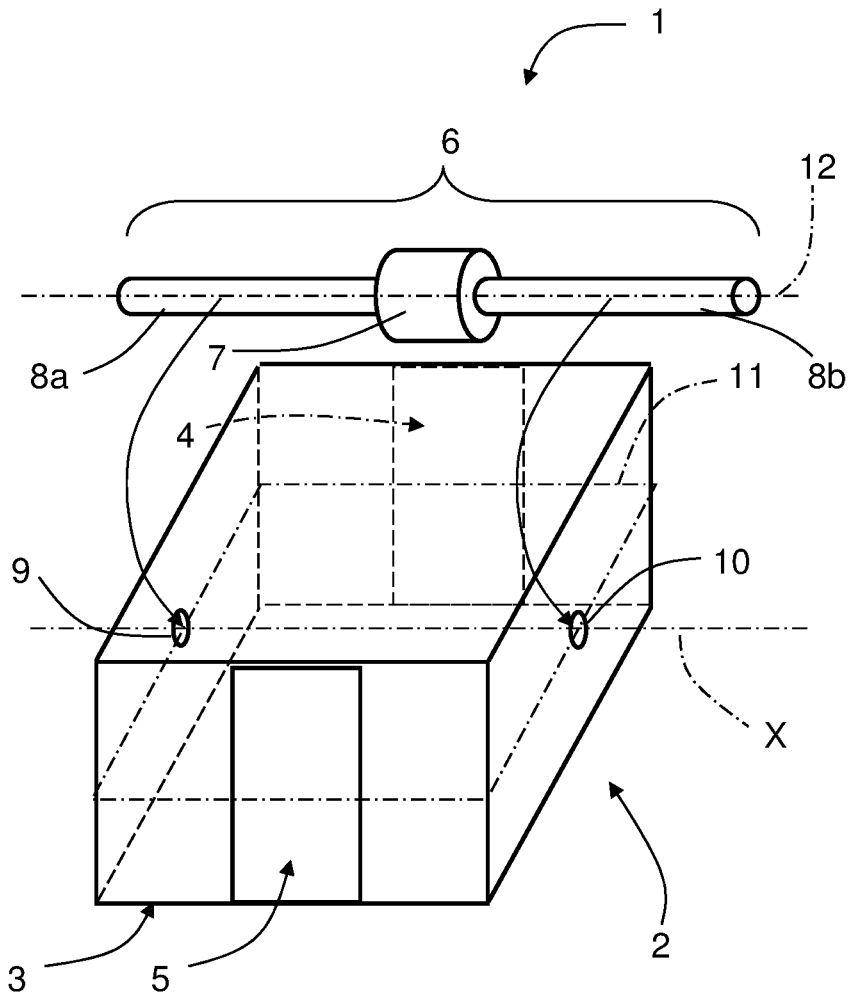
FIG. 1 shows a schematic perspective view of a tunable waveguide resonator.

With reference to FIG. 1, showing a schematic perspective view of a tunable waveguide resonator a first example of a tunable waveguide resonator will now be described.

The tunable waveguide resonator 1 comprises a rectangular waveguide part 2 having electrically conducting inner walls 3, a first waveguide port 4 and a second waveguide port 5. The resonator 1 comprises a tuning element 6 that is intended to be positioned between the waveguide ports 4, 5 as indicated with arrows. The waveguide ports 4, 5 are according to some aspects constituted by irises that each can be constituted by a limitation in the form of a partial electrically conducting wall partially closing the waveguide part.

According to the present disclosure, the tuning element 6 comprises an electrically conducting body 7 and a holding rod 8*a*, 8*b* that is attached to the electrically conducting body 7 and is movable from the outside of the resonator 1. This means that the electrically conducting body 7 can be moved between a plurality of positions within the waveguide part 2 by means of the holding rod 8*a*, 8*b*.

According to some aspects, the holding rod 8*a*, 8*b* and the electrically conducting body 7 form the tuning element 6 as an integral electrically conducting part, alternatively the holding rod comprises two separate rod parts 8*a*, 8*b* that are attached to opposite sides of the electrically conducting body 7 or one rod that runs through the tuning element 6. In the latter cases, the holding rod 8*a*, 8*b* can either be electrically conducting or not.

The holding rod 8*a*, 8*b* is extending through the waveguide part 2 via corresponding apertures 9, 10, enabling the electrically conducting body 7 to be movable from the outside of the resonator 1, and by moving the electrically conducting body 7 and thus displacing the electrically conducting body 7 within the waveguide part 2, the resonator 1 can be tuned with respect to its resonance frequency with a relatively high Q-value. The electrically conducting body 7 provides conductor loading and tuning the resonator over the frequency as it moves from the middle of the cavity, at the lowest frequency, towards the cavity wall, resulting in increasing frequency.

Figure 3:
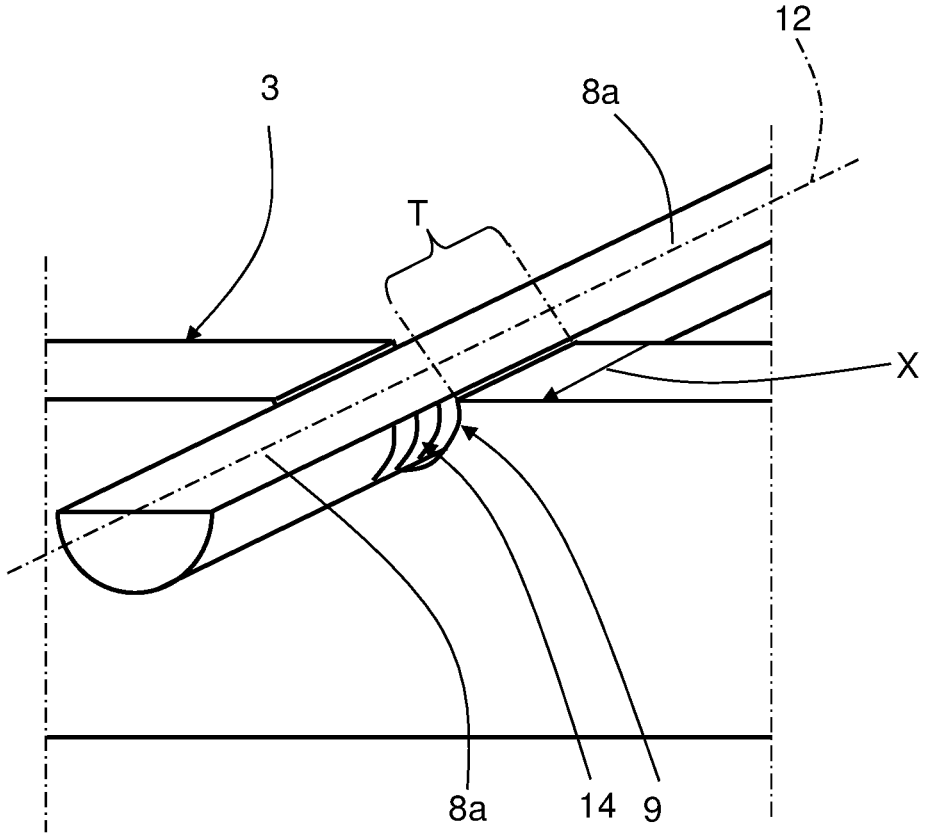
FIG. 3 shows a schematic section perspective view of a second example of tunable resonator.

With reference also to FIG. 3 that shows an enlarged section of a first aperture through a plane 11, in order to displace the electrically conducting body 7 within the waveguide part 2 in a controlled manner, according to some aspects, the apertures 9, 10 comprise threads (not visible) that engage corresponding threads 14 at the holding rod 8*a*, 8*b*. By means of the threads, angular rotation can be converted into a very precise linear movement of the electrically conducting body 7 inside the cavity.

Figure 2:
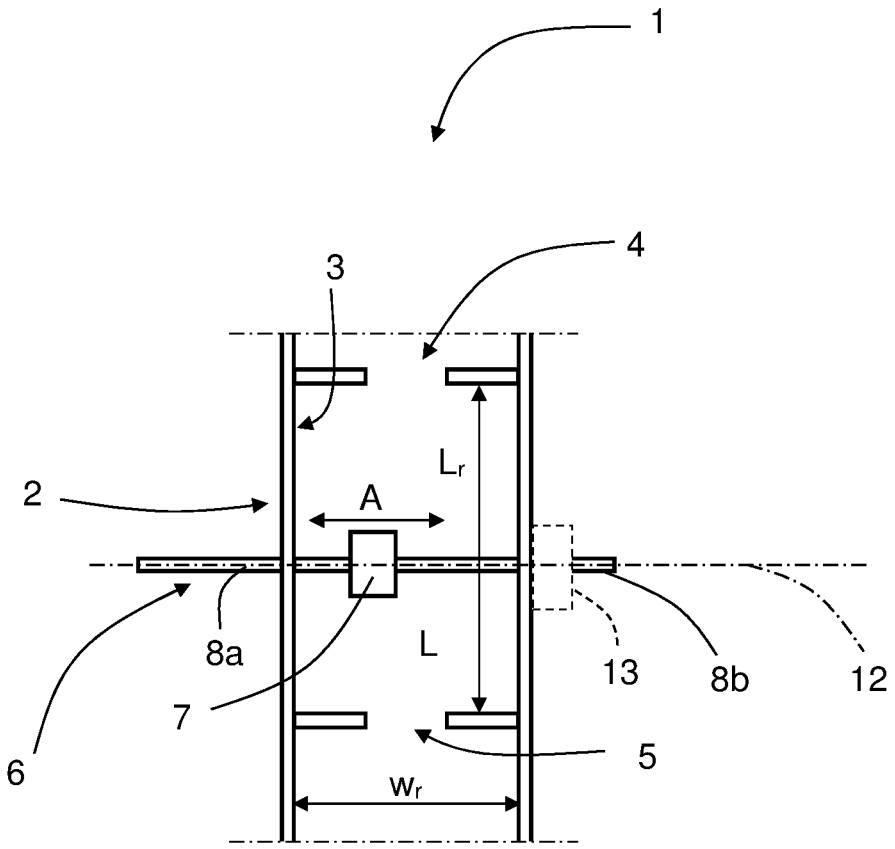
FIG. 2 shows a schematic cut-open top view of a first example of a tunable resonator.

With reference also to FIG. 2, showing a cut-open top view of a the tunable resonator 1, according to some aspects the tunable resonator 1 comprises an electrically controllable motor 13, where the holding rod 8*a*, 8*b* is connected to the electrically controllable motor 13. In this way, it is possible to electrically control the position of the electrically conducting body 7 within the waveguide part 2 and thus the resonance frequency of the tunable resonator 1.

The apertures 9, 10 cross the plane 11 that runs through the waveguide part 2 parallel to an extension axis 12 of the holding rod 8*a*, 8*b* when mounted. Only a mode with an electrical wall in the plane 11 is excited within the apertures 9, 10 such that power leakage via the apertures 9, 10 is avoided. This is the result since the excited mode is a non-propagating mode in a coaxial line, where a coaxial line is established by means of the holding rod 8*a*, 8*b* and the apertures 9, 10 serving as inner respective outer conductors.

Leakage of the power from the resonance cavity takes form of an evanescent wave that quickly decays in the apertures 9, and with a properly chosen thickness T of the waveguide part's wall power leakage via the apertures 9, 10 is avoided.

In the case of an electrically conducting holding rod 8*a*, 8*b*, there is no need for a good ohmic contact between the holding rod 8*a*, 8*b* and the waveguide part 2 since the connection is provided by a virtual electric wall between them. Since there is no voltage drop between the electrically conducting body 7 and the electrically conducting inner walls 3 in the plane 11, there is no current and thus no associated losses.

According to some aspects, the electrically conducting body 7 is a cylindrical part, resulting in that the resonance frequency of the cavity is not sensitive to the angular position of the electrically conducting body 7. In the case where a rotational movement of the holding rod 8*a*, 8*b* is used for moving the electrically conducting body 7, which then rotates along this movement, this is advantageous.

The present disclosure is based on using a conductor-loaded fundamental mode TE101 rectangular cavity. This results in an increased spurious-free rejection band and reduced size. According to some aspects, the conductor loading has rotational symmetry and interconnects the opposite electrically conducting inner walls 3.

By means of the present disclosure a reduced size is obtained since a fundamental TE101 mode of a rectangular cavity is used. Due to conductor loading that is used to tune the cavity over chosen frequency range, the size is further reduced. Furthermore, conductor loaded cavities have a wide spurious-free band, and since, as mentioned previously, the conductor loading does not require ohmic contact with the conducting inner walls, it is not dependent on its quality. In that follows that the Q-factor of the conductor loaded cavity is maintained on a level defined mainly by the size of the electrically conducting body 7 and the cavity. Moving the electrically conducting body 7, that constitutes a load, inside the cavity, i.e. tuning its resonance frequency, affects the Q-factor to a very small extent.

The present disclosure is not limited to the above, but may vary within the scope of the appended claims. For example, the electrically conducting body 7 can be square, rectangular, hexagonal, etc.

The waveguide part 2 as well as the electrically conducting body 7 can be made in any suitable metal such as aluminum, or as a metal plating on a non-conducting material such as plastics. A metal plating can also be used to cover another metal totally or partially.

One or more tunable waveguide resonators according to the above are according to some aspects comprised in a waveguide filter.

Generally, the tunable waveguide resonator 1 comprising a rectangular waveguide part 2 having electrically conducting inner walls 3, a first waveguide port 4 and a second waveguide port 5, where the resonator 1 comprises at least one tuning element 6 positioned between the waveguide ports 4, 5, wherein each tuning element 6 comprises an electrically conducting body 7 and a holding rod 8*a*, 8*b*, where the holding rod 8*a*, 8*b* is attached to the electrically conducting body 7 and is movable from the outside of the resonator 1 such that the electrically conducting body 7 can be moved between a plurality of positions within the waveguide part 2 by means of the holding rod 8*a*, 8*b*.

According to some aspects, the waveguide ports 4, 5 are constituted by iris openings.

According to some aspects, the holding rod 8*a*, 8*b* is electrically conducting.

According to some aspects, the holding rod 8*a*, 8*b* is extending through the waveguide part 2 via corresponding apertures 9, 10, where these apertures 9, 10 cross a plane 11 running through the waveguide part 2 parallel to an extension axis 12 of the holding rod 8*a*, 8*b* when mounted, where only a mode with an electrical wall in the plane 11 is excited within the apertures 9, 10 such that power leakage via the apertures 9, 10 is avoided.

According to some aspects, the holding rod 8*a*, 8*b* is connected to an electrically controllable motor 13.

According to some aspects, the electrically conducting body 7 is a cylindrical part.

According to some aspects, the tuning element 6 is integrally formed as one part.

According to some aspects, the holding rod comprises two separate rod parts 8*a*, 8*b* that are attached to opposite sides of the electrically conducting body 7.

According to some aspects, the holding rod 8*a*, 8*b* comprises one integral part that is running through the electrically conducting body 7.

The invention claimed is:

1. A tunable waveguide resonator comprising: a rectangular waveguide part having electrically conducting inner walls, a first waveguide port and a second waveguide port, where the resonator comprises at least one tuning element positioned between the waveguide ports, wherein each tuning element comprises an electrically conducting body and a holding rod, where the holding rod is attached to the electrically conducting body and is movable from the outside of the resonator such that the electrically conducting body can be moved between a plurality of positions within the waveguide part by the holding rod, wherein an interior of the rectangular waveguide part between the waveguide ports comprises only the electrically conducting body and the holding rod for each tuning element.

2. The tunable waveguide resonator according to claim 1, wherein the waveguide ports are constituted by iris openings, wherein each iris opening partially closes the waveguide part.

3. The tunable waveguide resonator according to claim 1, wherein the holding rod is electrically conducting.

4. The tunable waveguide resonator according to claim 1, wherein the holding rod is extending through the waveguide part via corresponding apertures, where these apertures cross a plane running through the waveguide part parallel to an extension axis of the holding rod when mounted, where only a mode with an electrical wall in the plane is excited within the apertures such that power leakage via the apertures is avoided.

5. The tunable waveguide resonator according to claim 1, wherein the holding rod is connected to an electrically controllable motor.

6. The tunable waveguide resonator according to claim 1, wherein the electrically conducting body is a cylindrical part.

7. The tunable waveguide resonator according to claim 1, wherein the tuning element is integrally formed as one part.

8. The tunable waveguide resonator according to claim 1, wherein the holding rod comprises two separate rod parts that are attached to opposite sides of the electrically conducting body.

9. The tunable waveguide resonator according to claim 1, wherein the holding rod comprises one integral part that is running through the electrically conducting body.

10. The tunable waveguide resonator of claim 1, wherein the holding rod is extending through the waveguide part via corresponding apertures, where the apertures comprise threads that engage corresponding threads in the holding rod and wherein by means of the threads angular rotation of the holding rod is converted to linear movement of the electrically conducting body inside the waveguide part.

* * * * *